United States Patent [19]

Kawasaki et al.

[11] 4,224,195

[45] Sep. 23, 1980

[54] PROCESS FOR HANDWASHING SOCKS OR STOCKINGS

[75] Inventors: Yoshimi Kawasaki, Fujieda; Izumi Imaseki, Tokyo; Satoshi Hirano, Fujieda; Katsuhiko Amano, Fujieda; Masatsune Shigematsu, Fujieda, all of Japan

[73] Assignee: Kabushiki Kaisha Tsumura Jutendo, Tokyo, Japan

[21] Appl. No.: 923,946

[22] Filed: Jul. 11, 1978

Related U.S. Application Data

[63] Continuation of Ser. No. 756,954, Jan. 5, 1977, abandoned.

[30] Foreign Application Priority Data

Apr. 28, 1976 [JP] Japan ..... 51-47838

[51] Int. Cl.[2] ..... C11D 1/38; C11D 3/28

[52] U.S. Cl. ..... 252/546; 252/89.1; 252/531; 252/532; 252/540; 252/542; 252/549; 252/551; 252/559; 252/153; 252/DIG. 7; 252/DIG. 14; 8/137

[58] Field of Search ..... 252/89, 531, 532, 540, 252/542, 546, 549, 551, 559, 153, DIG. 7, DIG. 14; 8/137

[56] References Cited

U.S. PATENT DOCUMENTS

| | | | |
|---|---|---|---|
| 3,776,851 | 12/1973 | Cheng | 252/532 |
| 3,812,042 | 5/1974 | Le Bourget | 252/DIG. 14 |
| 3,928,251 | 12/1975 | Bolich, Jr. | 252/DIG. 7 |
| 3,935,130 | 1/1976 | Hiraro et al. | 252/DIG. 14 |

OTHER PUBLICATIONS

"Tergitols" Biodegradable Surfactants, Union Carbide, pp. 2 & 12 relied on, 1966.

*Primary Examiner*—Mayer Weinblatt
*Attorney, Agent, or Firm*—Haseltine, Lake & Waters

[57] ABSTRACT

A process for handwashing socks or stockings which utilizes a detergent composition having, as effective components, an ethylene oxide adduct of a secondary alcohol, a sulfuric ester salt of an ethylene oxide adduct of a secondary alcohol, and an amphoteric surfactant is described.

7 Claims, No Drawings

PROCESS FOR HANDWASHING SOCKS OR STOCKINGS

This is a continuation of U.S. Ser. No. 756,954, filed Jan. 5, 1977, now abandoned.

BACKGROUND OF THE INVENTION

The present invention relates to a new detergent composition. More specifically, it is concerned with a detergent composition suitable for use in washing socks and stockings.

Heretofore, conventional detergents for clothings have been used in washing socks and stockings. When the socks and stockings are washed together with other clothes in a washing machine using these detergents, many problems arise. For example, the rubbered garter section of the socks and stockings is loosened; the fiber from which the socks and stockings are made deteriorates; the fiber waste of other clothes adheres to the socks and stockings; and difficulty is encountered in rinsing the socks and stockings. In addition to these difficulties, the offensive odor inherent in the socks and stockings soaks into other clothes.

Further, when the socks and stockings are handwashed using the above mentioned detergents, the detergents heavily foam, so that they are unfavourable on the points of rinsability, deodorization, and prevention of hand chap.

In addition, detergents which are generally called detergents for wool have also been used in washing socks and stockings. In most cases, these detergents are used in washing by hand. However, these detergents have selectivity with respect to fiber materials and are not useful for a wide range of raw fiber materials. Also, unless tepid water is used, they cannot satisfactorily exhibit their detergency. Additionally, those detergents are not satisfactory as detergents for socks and stockings on the points of rinsability and deodorization.

SUMMARY OF THE INVENTION

It is an object of the present invention to provide a detergent composition particularly favorable as a detergent for use in laundering socks and stockings which overcomes the above mentioned difficulties associated with the conventional detergents for clothings.

The detergent composition of the present invention comprises, as effective components, an ethylene oxide adduct of a secondary alcohol, a sulfuric ester salt of an ethylene oxide adduct of a secondary alcohol, and an amphoteric surfactant.

Generally, a fiber material for socks and stockings includes cotton, nylon, acrylic, polyurethane, polyester, acetate, rayon, wool, and silk. These fiber materials are used singly or in combination. Therefore, a detergent for socks and stockings must have excellent detergency for dirt adhering to the above mentioned fiber materials, and excellent deodorization and must be effective for all types of fiber material. Further, it is necessary that the detergent must not damage the fiber material and must be easily rinsed out.

The dirt of socks and stockings is generally divided into dirt arising from the interior thereof and dirt accumulated from the exterior thereof when one is wearing them. The dirt produced from the interior includes oily and greasy grime, hydrocarbon contaminants and salts, such as perspiration, sebum and skin dirt. The dirt accumulated from the exterior includes, in particular, dust and dirt. In addition to the adherence of these dirts, the smell of a shoe material, for example, the smell of rubber or leather, soaks into the socks and stockings. Thus, the dirt of the socks and stockings is considered to be a combination of these dirts and smells. Consequently, soiled socks and stockings almost always reek with the smell of sweat and a putrid and offensive ordor which promote the growth of fungi and render them unsanitary.

We have made many attempts to develop a detergent composition useful for removing the dirt and odor characteristic of socks and stockings. As a result, we have found that when a detergent composition comprising, as effective components, an ethylene oxide adduct of a secondary alcohol, a sulfuric ester salt of an ethylene oxide adduct of a secondary alcohol, and an amphoteric surfactant is dissolved in water and soiled socks and stockings are immersed in the solution for a certain period of time, for example, an hour, only a subsequent slight hand washing and rinsing are necessary to produce odorless and clean socks and stockings without the aforementioned difficulties encountered in washing the socks and stockings with detergents for general clothings or for wool. On the basis of this discovery, we have developed this invention.

DETAILED DESCRIPTION

The ethylene oxide adduct of a secondary alcohol usable for the present invention is suitably a secondary alcohol having from 10 to 16 carbon atoms, for example, a mixture of secondary alcohols having from 11 to 15 carbon atoms with from 3 to 12 ethylene oxides added thereto. Examples of the adduct are a mixture of secondary alcohols having from 11 to 15 carbon atoms with 3, 5, 9 or 12 moles of ethylene oxide added thereto and a mixture of secondary alcohols having from 14 to 15 carbon atoms with 3, 5 or 10 moles of ethylene oxide added thereto.

The sulfuric ester salt of an ethylene oxide adduct of a secondary alcohol usable for the present invention is suitably a salt of sulfate of a secondary alcohol having from 10 to 16 carbon atoms, such as, for example, a mixture of secondary alcohols having from 11 to 15 carbon atoms with from 1 to 8 ethylene oxides added thereto. Suitable types of the salt are sodium salts, ammonium salts, monoethanolamine salts, diethanolamine salts, and triethanolamine salts. Examples of the sulfuric ester salt are sodium, triethanolamine and ammonium salts of a mixture of $C_{11}$-$C_{15}$ secondary alcohols ethoxysulfate having 3 moles of ethylene oxide added thereto and sodium, triethanolamine and ammonium salts of a mixture of $C_{14}$-$C_{15}$ secondary alcohols ethoxysulfate having 3 moles of ethylene oxide added thereto.

Examples of suitable amphoteric surfactants usable in the present invention are alkyl glycine amphoteric surfactants wherein the alkyl has 8 to 18 carbon atoms such as alkyldiaminoethylglycines wherein the alkyl has 8 to 18 carbon atoms; betaines such as alkyldimethylbetaines wherein the alkyl has 12 to 18 carbon atoms and imidazolines such as cyclic imidinum amphoteric surfactants disclosed in U.S. Pat. No. 2,773,068 and having the formula:

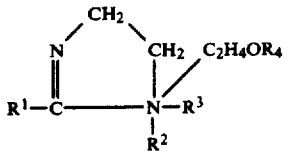

wherein $R^1$ is an aliphatic hydrocarbon group of 7 to 17 carbon atoms, $R^2$ is a member selected from the group consisting of hydroxyl, $$C_{11}H_{23}CO\underset{\underset{CH_3}{|}}{N}CH_2COO,$$

$C_{12}H_{25}OSO_3$ and $C_{13}H_{27}(OC_2H_4)_2OSO_3$, $R^3$ is a member selected from the group consisting of $CH_2COOH$, $CH_2COONa$ and $$CH_2\underset{\underset{OH}{|}}{C}HCH_2SO_3Na,$$

and $R^4$ is a member selected from the group consisting of hydrogen, alkali metals, $CH_2COOH$, $CH_2COONa$ and $CH_2$ COOK.

The particular effectiveness for washing socks and stockings of the detergent composition comprising, as effective compounds, the ethylene oxide adduct of a secondary alcohol, the sulfuric ester salt of an ethylene oxide adduct of a secondary alcohol, and the amphoteric surfactant will be illustrated by the following experimental examples and comparative experimental examples.

Detergency Test 1

The components indicated in Table 1 in the amounts of the ratio indicated in Table 1 were mixed with stirring to prepare a sample of a detergent composition. The total net content of the surfactants constituted 20 parts out of 100 parts of the composition.

Sample VI is a detergent composition comprising an ethylene oxide adduct of a secondary alcohol and a sulfuric ester of an ethylene oxide adduct of a secondary alcohol, and samples I through V are comparison samples.

TABLE 1

| Ratio | Sample I | II | III | IV | V | VI |
|---|---|---|---|---|---|---|
| 33 parts | $C_{12}$–$C_{15}$ primary alcohol ethoxysulfate (addition of 3 moles of E.O.) | $C_{12}$ natural alcohol ethoxysulfate (addition of 3 moles of E.O.) | Sodium salt of $C_{12}$ natural alcohol sulfate | Linear alkylbenzenesulfonate ($C_{12}$ alkyl) | Normal paraffin sulfonate ($C_{14}$–$C_{16}$ paraffin) | Triethanolamine salt of $C_{11}$–$C_1$ secondary alcohol ethoxysulfate (addition of 3 moles of E.O.) |
| 67 parts | Polyoxyethylene nonyl phenol ether (E.O. 10 moles) | | | | | Ethylene oxide adduct of $C_{11}$–$C_{15}$ secondary alcohol (addition of 9 moles of E.O.) |
| Balance | Purified water | | | | | |

Note: E.O. = ethylene oxide (1) Detergency test (according to reflectance measurement):

Socks to which natural dirts were adhering after one day's wear were immersed in an aqueous solution of each of the samples indicated in Table 1 for 1 hour, wherein the concentration was adjusted to a constant concentration (3.5 ml./l. water), and rinsed twice with water.

Each of the socks was evaluated for the reflectance (Rc) in percent before wearing, the reflectance (Rs) in percent after wearing and the reflectance (Rw) in percent after washing by means of a glossmeter (Model GM-24, manufactured by Murakami Color Technology Institute K.K.). The percent detergency was determined by the following equation:

$$\text{Percent detergency (\%)} = \frac{Rw - Rs}{Rc - Rs} \times 100$$

The results so obtained are shown in Table 2. With regard to the percent detergency, a higher value indicates a higher detergency of the detergent composition.

TABLE 2

| Fiber material of socks | Sample I | II | III | IV | V | VI |
|---|---|---|---|---|---|---|
| Cotton mixed with acrylic, nylon and polyurethane | 67% | 74% | 70% | 67% | 74% | 76% |
| Wool mixed with nylon and polyurethane | 51 | 48 | 40 | 50 | 45 | 59 |
| Cotton 100% | 70 | 47 | 69 | 70 | 71 | 73 |
| Nylon 100% | 66 | 59 | 63 | 64 | 65 | 70 |

It is clear from Table 2 that the sample VI is superior in detergency to the samples 1 through V for all the types of fiber materials. However, it cannot be said that the detergent composition comprising only the ethylene oxide adduct of a secondary alcohol and the sulfuric ester salt of an ethylene oxide adduct of a secondary alcohol has sufficient detergency for the socks or stockings.

Then, an experiment was conducted by using a detergent composition comprising each of the samples I through VI to which an amphoteric surfactant was added.

Detergency Test 2

The components indicated in Table 3 in the amounts of the ratio indicated in Table 3 were mixed together with stirring to prepare samples of detergent composition. The total net content of the surfactants constituted 20 parts out of 100 parts of the composition.

Sample XII is a detergent composition comprising an ethylene oxide adduct of a secondary alcohol, a sulfuric ester salt of an ethylene oxide adduct of a secondary alcohol and an amphoteric surfactant (the detergent composition of the present invention), and the samples VII through XI are comparison samples.

TABLE 3

| Ratio | Sample VII | VIII | IX | X | XI | XII |
|---|---|---|---|---|---|---|
| 30 parts | $C_{12}$–$C_{15}$ primary alcohol ethoxysulfate (addition of 3 moles of E.O.) | $C_{12}$ natural alcohol ethoxysulfate (addition of 3 moles of E.O.) | Sodium salt of sulfuric ester of $C_{12}$ natural alcohol | Linear alkylbenzenesulfonate ($C_{12}$ alkyl) | Normal paraffin sulfonate ($C_{14}$–$C_{16}$ paraffin) | Triethanolamine salt of $C_{11}$–$C_{15}$ secondary alcohol ethoxysulfate (addition of 3 moles of E.O.) |
| 65 parts | Polyoxyethylene nonyl phenol ether (E.O. 10 moles) | | | | | Ethylene oxide adduct of $C_{11}$–$C_{15}$ secondary alcohol (addition of 9 moles of E.O.) |
| 5 parts | Miranol C2M Conc. | | | | | |
| Balance | Purified water | | | | | |

Note:
(1) E.O. = ethylene oxide
(2) Miranol C2M Conc. is a cyclic imidinum type amphoteric surfactant as disclosed in U.S. Pat. No. 2773068.

(1) Detergency test (according to reflectance measurement):

Each of the samples was evaluated for detergency according to the procedure described in the detergency test of Experimental Example 1. The results are shown in Table 4.

TABLE 4

| Fiber material of socks or stockings | Sample | | | | | XII This invention |
|---|---|---|---|---|---|---|
| Cotton mixed with acrylic, nylon and polyurethane | 66% | 71% | 70% | 60% | 69% | 78% |
| Wool mixed with nylon, and polyurethane | 61 | 54 | 42 | 50 | 50 | 73 |
| Cotton 100% | 80 | 50 | 75 | 81 | 81 | 85 |
| Nylon 100% | 77 | 66 | 75 | 75 | 75 | 85 |

(2) Permeability test:

The permeability test was conducted according to a canvas disc wetting test (Seyferth & Morgan, "Am. Dyestuff Reporter" 27, Sept. 19, 1938). A circular piece of felt having a diameter of 10 mm was placed on the surface of each of sample solutions contained in a container. The sample solutions used were a 0.5% aqueous solution of each of the samples VII through XII indicated in Table 3. Then, the time for the felt to sink to the bottom was determined for each of the solutions. The shorter the time, the higher is the permeability of the sample. The results are shown in Table 5.

TABLE 5

| Concentration | Sample VII | VIII | IX | X | XI | XII This invention |
|---|---|---|---|---|---|---|
| 0.5% solution temperature 20° C. | 30.9 sec. | 76.6 sec. | 15.8 sec. | 8.7 sec. | 10.3 sec. | 7.5 sec. |

(3) Rinsability, deodorization and feel tests:

Socks made of cotton-mixed yarns to which natural dirts were adhering after one day's wear were immersed in an aqueous solution of each of the samples VII through XII indicated in Table 3 at a temperature of 20° C. for 1 hour, wherein the concentration was adjusted to a constant concentration (3.5 ml./l.-water), and rinsed twice with water. Thereafter, the socks were dried in the sun.

A panel consisting of 30 persons evaluated each of the socks so treated with regard to rinsability, deodorization and feel. The results are shown in Table 6. The scores +2, +1, −1 and −2 represent "very good", "good", "bad" and "very bad", resectively.

TABLE 6

| Item | Sample VII | VIII | IX | X | XI | XII (This invention) |
|---|---|---|---|---|---|---|
| Rinsability | +1 | −1 | −1 | −2 | −1 | +1 |
| Deodorization | −1 | +1 | −1 | −2 | −1 | +2 |
| Feel | −1 | −1 | −1 | +1 | +1 | +1 |
| Total | −1 | −1 | −3 | −3 | −1 | +4 |

In this Detergency Test 2, the test results of each detergent composition containing the amphoteric surfactant (samples VII through XII) were obtained. From Table 4, it is apparent that the sample XII (this invention) has an extremely excellent detergency performance for a wide range of fiber materials.

This indicates that the addition of the amphoteric surfactant to the samples I through V (resulting in samples VII through XI) does not improve the detergency to a great extent, while in the case of the sample XII (this invention) the amphoteric surfactant in incorporated with the ethylene oxide adduct of a secondary alcohol and the sulfuric ester salt of an ethylene oxide adduct of a secondary alcohol to provide a synergistic effect. This synergistic effect is particularly conspicuous with the socks made of the wool-mixed yarn and of the 100% nylon yarn. Further, while there is a tendency for the samples VII through XI to provide a decreased detergency due to the addition of the amphoteric surfactant for the socks made of the cotton-mixed yarn, the sample XII (this invention) exhibits no such tendency and its detergency is not dependent on the type of fiber material of the socks or stockings.

Additionally, in the case where clothings are immersed in an aqueous solution containing a detergent composition to remove the dirt therefrom as is the case with the use of the present detergent composition, a high permeability is required which is an important factor for the affinity for the fiber and the removal of the dirt. In this respect, it is also apparent from Table 5 that the sample XII (this invention) has an excellent permeability. From Table 6, it is also evident that the sample XII (this invention) is excellent in rinsability, deodorization and feel as compared with the samples VII through XI, and it is particularly excellent in deodorization.

Now, the detergent composition of the present invention can be prepared by mixing with stirring (A) an ethylene oxide adduct of a secondary alcohol, (B) a sulfuric ester salt of an ethylene oxide adduct of a secondary alcohol, (C) an amphoteric surfactant, and water. In preparing the composition, the ratio of (A) to (B) is in the range of 95:5 to 30:70, preferably 80:20 to 50:50 by weight, and the weight ratio of [(A)+(B)] to (C) is in the range of 98:2 to 80:20, preferably 97:3 to 85:15.

When (A) is above 95 and (B) is below 5 in the ratio of (A) to (B), the detergency and the deodorization are poor. On the other hand, in the case where (A) is below 30 and (B) is above 70, the detergent is highly sudsing, and the rinsability and the permeability are poor.

In the case where [(A)+(B)] is above 98 and (C) is below 2 in the ratio of [(A)+(B)] to (C), the detergency will become dependency on the types of fiber materials so that the effectiveness for a wide range of fiber materials cannot be obtained, and the feel after washing is poor. On the other hand, when [(A)+(B)] is below 80 and (C) is above 20, the permeability is reduced with the result that detergency is decreased.

Therefore, the preferred mixing ratio is within the above mentioned range. The particularly preferred mixing ratio is in the range of from 80:20 to 50:50 by weight for the ratio of (A) to (B) and in the range of from 97:3 to 85:15 by weight for the ratio of [(A)+(B)] to (C).

The detergent compositions of the present invention can contain some additives such as fluorescent dyes, perfumes, sequestering agents, soil suspending agents, fungicides, thickners, solvents and alkaline detergency builders, if necessary. In this case, these ingredients can be suitably added in the course of the preparation of the detergent composition of the present invention.

In use, the detergent composition of the invention in a suitable amount (about 1 to 5 ml. per liter of water) is dissolved in water to prepare an aqueous solution into which socks and stockings are immersed for an appropriate period of time. Then, the socks and stockings are removed from the solution and rinsed with water and dried.

When soiled socks and stockings are subjected to an immersion washing wherein the detergent composition of the invention is used, good sudsing is provided, and excellent detergency and deodorization are attained. Furthermore, the smell characteristic of the socks and stockings is removed, whereby the socks and stockings are made clean. In addition, the rinsability is good and, after washing, an excellent feel is imparted to the socks and stockings. Furthermore, the detergent composition of the invention may be used in washing socks and stockings whose materials consist of a wide range of fibers. At the same time, this detergent possesses high safety and does not cause chapping of the hands.

Although, as mentioned above, the detergent composition of the present invention is an excellent detergent composition for washing socks and stockings as compared with detergent compositions for general clothings, it is to be understood that it can be used as a detergent for general clothings.

The features and advantages of the present invention will be concretely illustrated by the following examples, which are set forth as illustrative only and are not intended to limit the scope of the present invention.

EXAMPLE 1

72.7 parts of purified water, 19.0 parts of an ethylene oxide adduct of $C_{11}$–$C_{15}$ secondary alcohol (with the addition of 5 moles of E.O.), 5.0 parts of sodium salt of $C_{11}$–$C_{15}$ secondary alcohol ethoxysulfate (with the addition of 3 moles of E.O.), 1.0 part of an alkyldimethylbetaine, 2.0 parts of isopropyl alcohol, 0.2 part of hexachlorophene, and 0.1 part of a fluorescent dye were added in the order stated and mixed together with stirring to prepare a homogeneous composition.

The detergent composition thus obtained was dissolved in water in a ratio of 3 to 5 ml. per 1 liter of water to prepare an aqueous solution. Then, soiled socks were immersed in the solution for about 1 hour and, thereafter, the socks were removed from the solution and rinsed with water. The resulting socks were odorless and clean.

EXAMPLE 2

69.1 parts of purified water, 13.0 parts of an ethylene oxide adduct of $C_{11}$–$C_{15}$ secondary alcohol (with the addition of 9 moles of E.O.), 13.0 parts of triethanolamine salt of $C_{14}$–$C_{15}$ secondary alcohol ethoxy sulfate (with the addition of 3 moles of E.O.), 4.0 parts of an alkyldiaminoethylglycine, 0.3 part of disodium ethylenediaminetetraacetate, 0.5 part of sodium carboxymethyl cellulose and 0.1 part of fluorescent dye were added in the order stated and mixed together to prepare a homogeneous composition.

The detergent composition thus obtained was dissolved in water in a ratio of 3 to 5 ml. per 1 liter of water to prepare an aqueous solution. Then, soiled socks were immersed in the solution for about 1 hour and, thereafter, the socks were removed from the solution and rinsed with water. The resulting socks were odorless and clean.

EXAMPLE 3

58.0 parts of purified water, 22.0 parts of an ethylene oxide adduct of $C_{14}$–$C_{15}$ secondary alcohol (with the addition of 10 moles of E.O.), 15.0 parts of a sodium salt of $C_{11}$–$C_{15}$ secondary alcohol ethoxysulfate (with the addition of 3 moles of E.O.), 3.0 parts of Miranol C2M Conc. (a cyclic imidinum type amphoteric surfactant, manufactured by Miranol Corp., United States of America) 1.0 part of triethanolamine, and 1.0 part of a perfume were added in the order named and mixed together with stirring to prepare a homogeneous composition.

The detergent composition thus obtained was dissolved in water in a ratio of 3 to 5 ml. per 1 liter of water to prepare an aqueous solution. Then, soiled socks were immersed in the solution for about 1 hour and, thereafter, the socks were removed from the solution and rinsed with water. The resulting socks and stockings were odorless and clean.

We claim:

1. A process for washing socks or stockings which consists essentially of immersing socks or stockings in an aqueous solution of a detergent composition and washing same by hand, said detergent composition consisting essentially of, as effective components, an ethylene oxide adduct of one mole of a mixture of $C_{11}$–$C_{15}$ secondary alcohols and 3, 5, 9 or 12 moles of ethylene oxide, or one mole of a mixture of $C_{14}$–$C_{15}$ secondary alcohols and 3, 5 or 10 moles of ethylene oxide and mixtures thereof, and an ethoxy sulfate salt of an ethylene oxide adduct of a mixture of one mole of $C_{11}$–$C_{15}$ or $C_{14}$–$C_{15}$ secondary alcohols and 3 moles of ethylene oxide, and mixtures thereof, and an amphoteric surfactant selected from the group consisting of alkyldiaminoethylglycines wherein the alkyl group has from 8 to 18 carbon atoms, alkyldimethylbetaines wherein the alkyl group has from 12 to 18 carbon atoms and cyclic imidinium amphoteric surfactants of the formula:

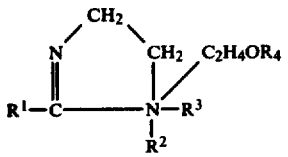

wherein $R^1$ is an aliphatic hydrocarbon group of 7 to 17 carbon atoms, $R^2$ is a member selected from the group consisting of hydroxyl, $$C_{11}H_{23}CO\underset{\underset{CH_3}{|}}{N}CH_2COO,$$

$C_{12}H_{25}OSO_3$, and $C_{13}H_{27}(OC_2H_4)_3OSO_3$, $R^3$ is a member selected from the group consisting of $CH_2COOH$, $CH_2COONa$, and $$\underset{\underset{OH}{|}}{CH_2CH}CH_2SO_3Na,$$

$R^4$ is a member selected from the group consisting of hydrogen, alkali metals, $CH_2COOH$, $CH_2COONa$ and $CH_2COOK$; the weight ratio of the ethylene oxide adduct of a secondary alcohol to the surfuric ester salt of an ethylene oxide adduct of a secondary alcohol being in the range of from 95:5 to 30:70 and the weight ratio of the total of the ethylene oxide adduct of a secondary alcohol and the sulfuric ester salt of an ethylene oxide adduct of a secondary alcohol to the amphoteric surfactant being from 98:2 to 80:20.

2. The process according to claim 1, wherein the ethylene oxide adduct is 1 mole of a mixture of $C_{11}$–$C_{15}$ secondary alcohols having 3, 5, 9 or 12 moles of ethylene oxide.

3. The process according to claim 1 wherein the ethylene oxide adduct is 1 mole of a mixture of $C_{14}$–$C_{15}$ secondary alcohols having 3, 5, or 10 moles of ethylene oxide.

4. The process according to claim 1 wherein the weight ratio of the ethylene oxide adduct of a secondary alcohol to the sulfuric ester salt of an ethylene oxide adduct of a secondary alcohol is in the range of from 80:20 to 50:50.

5. The process according to claim 1 wherein the weight ratio of the total of the ethylene oxide adduct of a secondary alcohol and the sulfuric ester salt of an ethylene oxide adduct of a secondary alcohol to the amphoteric surfactant is in the range of from 97:3 to 85:15.

6. The process according to claim 1 wherein the sulfuric ester salt is selected from the group consisting of sodium, ammonium, monoethanolamine, diethanolamine, and triethanolamine salts.

7. The process according to claim 6 wherein the sulfuric ester salt is selected from the group consisting of sodium, triethanolamine and ammonium salts of an ethoxy sulfate of an adduct of 1 mole of a mixture of $C_{14}$–$C_{15}$ secondary alcohols having 3 moles of ethylene oxide.

* * * * *